US007853178B2

(12) United States Patent
Foster et al.

(10) Patent No.: US 7,853,178 B2
(45) Date of Patent: Dec. 14, 2010

(54) METHODS AND DEVICES FOR SELECTIVELY DRIVING DEVELOPER MEMBERS WITHIN AN IMAGE FORMING DEVICE

(75) Inventors: Larry Steven Foster, Lexington, KY (US); Paul Douglas Horrall, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 917 days.

(21) Appl. No.: 11/692,259

(22) Filed: Mar. 28, 2007

(65) Prior Publication Data

US 2008/0240783 A1 Oct. 2, 2008

(51) Int. Cl.
*G03G 15/00* (2006.01)
*G03G 15/01* (2006.01)
*G03G 15/08* (2006.01)

(52) U.S. Cl. ..... 399/167; 399/223; 399/236

(58) Field of Classification Search ..... 399/167, 399/223, 228, 236
See application file for complete search history.

(56) References Cited

U.S. PATENT DOCUMENTS 4,591,261 A * 5/1986 Saruwatari et al. ..... 399/167
5,321,475 A * 6/1994 Horiuchi et al. ..... 399/236
5,440,377 A * 8/1995 Izawa et al. ..... 399/236
6,374,065 B1 * 4/2002 Nishimura et al. ..... 399/236
6,643,484 B2 * 11/2003 Kojima et al. ..... 399/236
7,298,984 B2 * 11/2007 Yukutake et al. ..... 399/223
7,317,889 B2 * 1/2008 Suzuki ..... 399/236

* cited by examiner

*Primary Examiner*—William J Royer

(57) ABSTRACT

A method and device for controlling toner transfer during the formation of a toner image within an image forming device is described herein. One exemplary image forming device includes a toner reservoir that stores toner of a first color, a developer member that receives toner from the toner reservoir, a photoconductive member proximate the developer member that receives toner from the developer member, and a driver. While rotating the photoconductive member, the driver selectively rotates the developer member based on a color content of the image. For example, the driver does not rotate the developer member while rotating the photoconductive member when the toner image being formed lacks the first color. Alternatively, the driver lows the rotational speed of the developer member while rotating the photoconductive member when the toner image being formed lacks the first color.

20 Claims, 5 Drawing Sheets

METHODS AND DEVICES FOR SELECTIVELY DRIVING DEVELOPER MEMBERS WITHIN AN IMAGE FORMING DEVICE

BACKGROUND

The present application is directed to devices and methods for forming a toner image within an image forming device and, more particularly, to devices and methods that selectively drive developer members to prevent unnecessary wear on the toner.

Color image forming devices contain two or more cartridges, each of which transfers a different color of toner to a media sheet as required to produce a full color copy of a toner image. One common image forming device includes four separate cartridges for each of yellow, magenta, cyan, and black colors. Image formation for each cartridge includes moving the toner from a reservoir to a developer roll, from the developer roll to a photoconductive member, and from the photoconductive member to either a media sheet or an intermediate member. The toner image from each cartridge are formed on the media sheet in an overlapping arrangement that ultimately forms the final composite toner image.

In many devices, each cartridge is driven during image formation, even when one or more colors are not being used for the specific print job. When the cartridge is driven, the developer roll forces toner through multiple compressive nips, even when the developer roll is not actually transferring toner. Repeatedly passing toner through the compressive nips inflicts some level of damage to the toner. Worn or damaged toner particles may fail to transfer or may transfer too readily to the photoconductive member. Thus, each time a given particle of toner passes through a nip, the likelihood of that particle responding to the image formation process decreases.

Devices and methods to reduce or eliminate undue wear on the toner would result in better overall efficiency of the image forming device. This in turn would increase the amount of toner available for transfer to the media sheets, and would decrease the amount of wasted toner.

SUMMARY

The present application is directed to methods and devices for controlling toner transfer during the formation of a toner image within an image forming device. One exemplary method comprises rotating one or more photoconductive members of the image forming device when forming a toner image, and selectively stopping or slowing the rotation of a developer member contacting at least a portion of one photoconductive member based on a color content of the toner image. For example, the method may rotate photoconductive and developer members associated with a first color when forming a first portion of the toner image containing the first color. When forming a second portion of the toner image lacking the first color, the method stops or slows the rotation of the developer member.

One exemplary forming device includes a toner reservoir that stores toner of a first color, a developer member that receives toner from the toner reservoir, a photoconductive member proximate the developer member that receives toner from the developer member, and a driver. The driver independently rotates the developer member and the photoconductive member. When a toner image being formed lacks the first color, the driver selectively stops or slows the rotation of the developer member while maintaining the normal rotation of the photoconductive member.

DETAILED DESCRIPTION

The present application is directed to methods and devices for reducing and/or eliminating undue churning of toner within a cartridge. In one embodiment, this includes selectively driving a developer member such that it is in motion long enough to ramp up to a desired rotational speed, transfer a desired amount of toner to a photoconductive member, and decelerate back to rest or to a slower, idle rotational speed.

Figure 1:
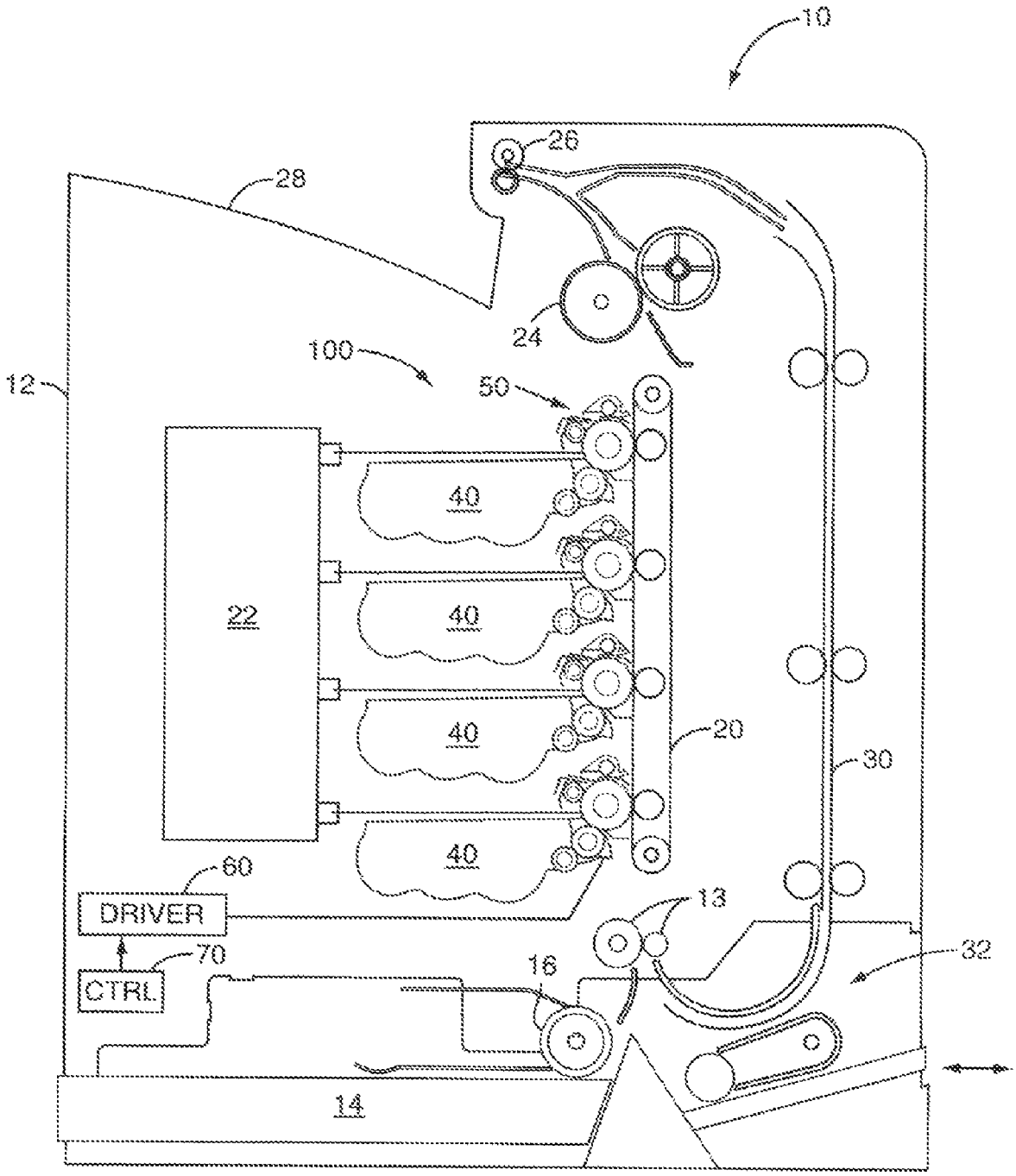
FIG. 1 is a schematic side view of an image forming device according to one embodiment.

FIG. 1 depicts a representative image forming device, such as a printer, indicated generally by the numeral 10. Image forming device 10 comprises a main body 12 sized to contain two or more cartridges 100. A manual input 32 or a media tray 14 with a pick mechanism 16 provide conduits for introducing media sheets into the device 10. The media tray 14 is preferably removable for refilling, and located on a lower section of the body 12.

Media sheets move from the input and feed into a primary media path. One or more registration rollers 13 disposed along the media path aligns the print media and precisely controls its further movement along the media path. A media transport belt 20 forms a section of the media path for moving the media sheets past the plurality of cartridges 100. Color image forming devices 10 typically include four cartridges 100 for up to four different colors of toner to produce a final, full-color toner image on the media sheet.

Each final toner image is formed by one or more different toner colors. If a particular color is to be included within the final toner image, an imaging device 22 forms a latent image at a predetermined electrical charge on a photoconductive member 51 within the specific cartridge 100. A driver 60 rotates the photoconductive member 51 and a developer member 45 of each included cartridge 100 responsive to instructions from a controller 70. A separate toner image is created on each of the included photoconductive members 51 that is then transferred to the media sheet as it passes along on the transport belt 20. Some final toner images are formed with a single toner color (e.g., text messages formed exclusively with black toner). In these embodiments, only black toner from the corresponding black cartridge is transferred to the media sheet and no toner is transferred from the remaining cartridges 100. Some final toner images are formed with each of the available toner colors. In these embodiments, a separate toner image is formed on each photoconductive member 51 and then transferred to form a composite, overlapping arrangement on the media sheet as it passes along on the belt 20. It is to be understood that various other final toner images may be formed by combinations of two or more different toner colors.

The media sheet with loose toner then moves through a fuser 24 that adheres the toner to the media sheet. Exit rollers 26 rotate in a forward or a reverse direction to move the media sheet to an output tray 28 or a duplex path 30. The duplex path 30 directs an inverted media sheet back through the media path to form a toner image on a second side of the media sheet.

Figure 2:
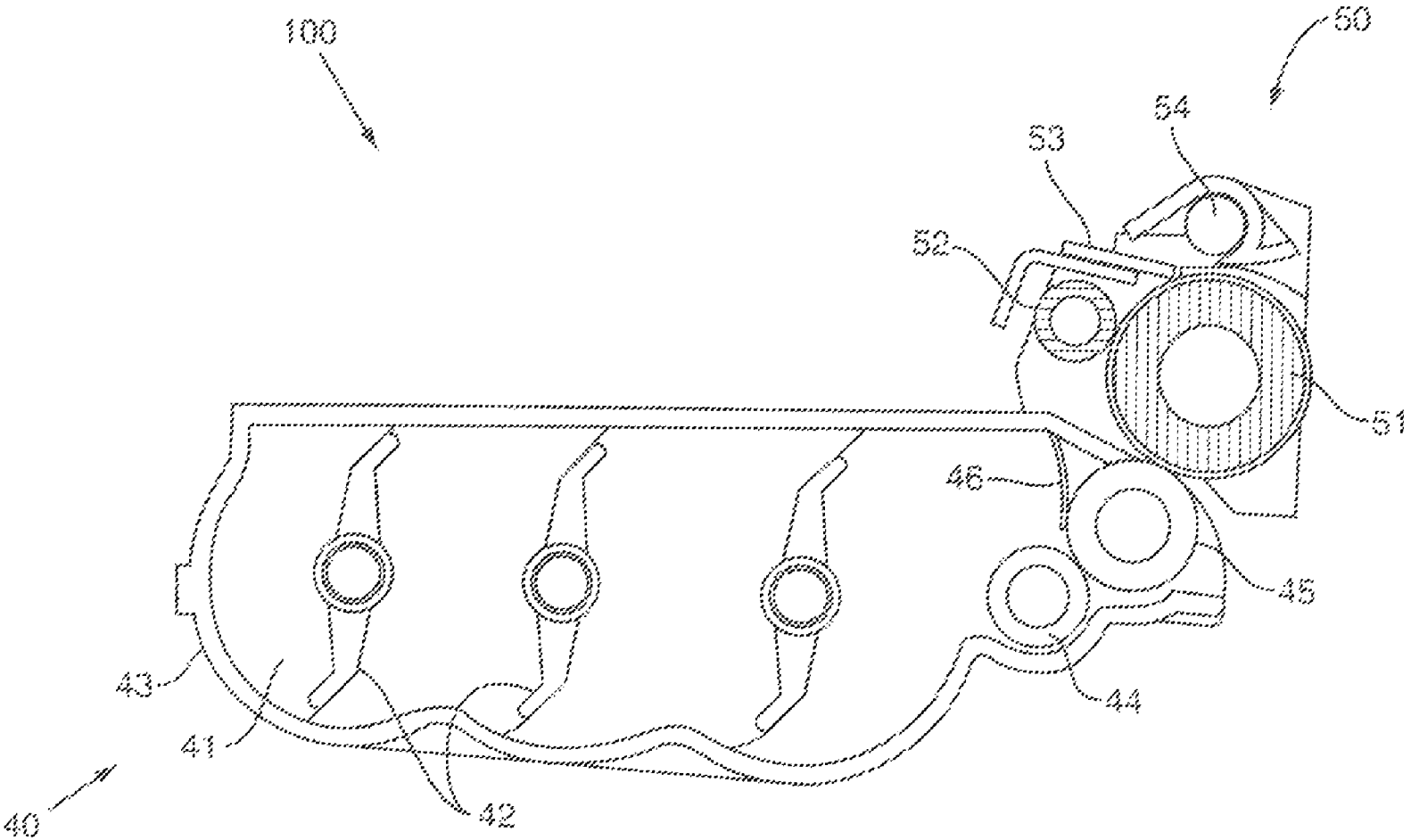
FIG. 2 is a sectional view of a cartridge according to one embodiment.

As illustrated in FIG. 2, one exemplary cartridge 100 comprises a developer unit 40 and a photoconductor unit 50. The developer unit 40 comprises an exterior housing 43 that forms a reservoir 41 for holding a supply of toner. The toner has a color, such as a black, cyan, magenta, or yellow color. One or more agitating members 42 are positioned within the reservoir 41 for agitating and moving the toner. Toner moves from the reservoir 41 via the one or more agitating members 42 to a toner adder member 44, and finally is distributed to the developer member 45. A doctor blade 46 adjacent to the developer member 45 controls the amount of toner distributed onto the developer member 45.

The photoconductor unit 50 comprises the photoconductive member 51 disposed proximate the developer member 45. In one embodiment, the photoconductive member 51 abuts against the developer member 45. Photoconductive member 51 may comprise an aluminum hollow-core drum coated with one or more layers of light-sensitive organic photoconductive materials. The photoconductor unit 50 may also include a charger 52 that applies an electrical charge to the photoconductive member 51 in preparation to receive the electrostatic latent image from the imaging device 22 (FIG. 1). The charge established for the latent image is set to attract toner from the developer member 45. A cleaner blade 53 contacts the surface of the photoconductive member 51 to remove residual toner that remains on the photoconductive member 51. The residual toner is moved to a waste toner auger 54 and moved out of the photoconductor unit 50.

When the developer member 45 rotates, the toner move through multiple compressive nips including between the toner adder member 44 and developer member 45, between the developer member 45 and the doctor blade 46, and even between the agitating members 42 and the housing 43. Movement through these compressive nips occurs even when the toner does not transfer to the photoconductive member 51. This movement causes wear on the toner. The methods and devices of the present application reduce undue toner wear by selectively rotating the developer member 45 based on the color content of ah image. For example, when the portion of the toner image being formed contains the toner color associated with the particular cartridge 100, the driver 60 rotates the corresponding developer member 45 within that cartridge 100. When the portion of the toner image being formed lacks the toner color, driver 60 does not rotate the developer member 45.

Figure 3:
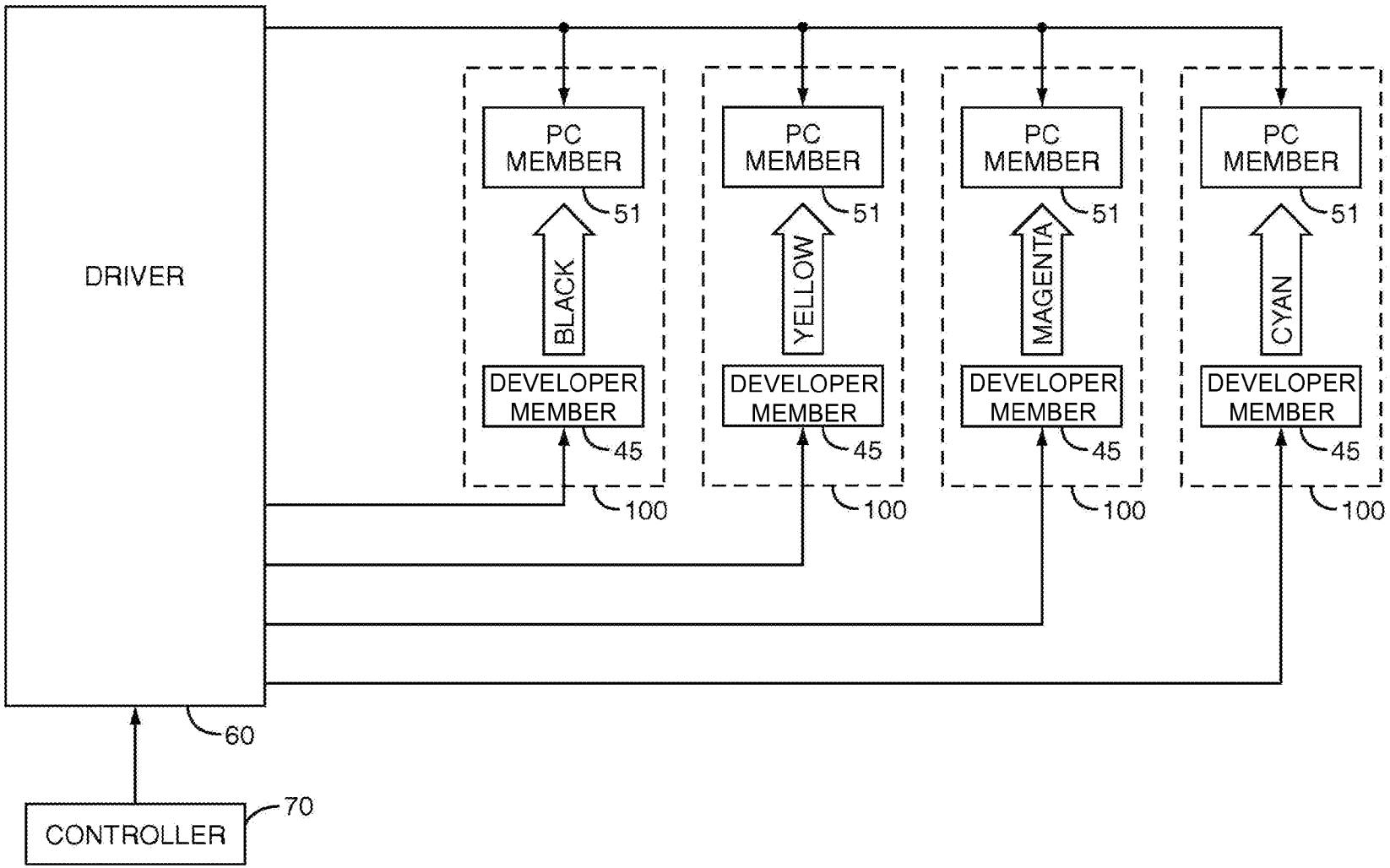
FIG. 3 shows a block diagram of one exemplary cartridge control system.

FIG. 3 illustrates a block diagram of the interconnection between the driver 60, developer members 45, and photoconductive members 51 of four separate cartridges 100. The controller 70 evaluates an image to determine the color content of the image. Once the image is evaluated, the controller 70 provides instructions to the driver 60 to selectively drive the developer member 45 of each cartridge 100 with the corresponding color included within the toner image, while simultaneously driving all photoconductive members 51. Developer members 45 in cartridges 100 containing a color not included in the toner image are not driven.

The controller 70 may use any method to determine the color content of the image. In one exemplary embodiment, the controller 70 may divide the image into tiles having a predetermined size. Exemplary tiles may comprise swaths across the width of the image having a predetermined height, such as ¼". The controller 70 determines and stores the color content of each tile. Using this information, the controller 70 determines which toner colors are required for each tile, and controls the driver 60 to selectively rotate each included developer member 45 accordingly. Using the four cartridge image forming device 100 of FIG. 1 as an example, if one tile contains a black color and a magenta color, controller 70 instructs the driver 60 to drive developer members 45 in the black and magenta cartridges 100, and not drive the developer members 45 in the yellow and cyan cartridges 100. If a subsequent tile contains a black color, a cyan color, and a yellow color, the controller 70 instructs the driver 60 to maintain the rotation of the developer 45 in the black cartridge 100, to begin the rotation of the developer 45 in the cyan and yellow cartridges 100, and to halt the rotation of the developer 45 in the magenta cartridge 100. It will be appreciated that while the above example describes stopping the rotation of the developer members 45 in the cartridges 100 containing colors not present in a tile, the controller 70 may alternatively slow the rotations of the developer member(s) 45 associated with absent toner colors to a rotational speed less than the normal rotational speed of the developer member(s) 45 associated with toner colors present in the tile.

Figure 4:
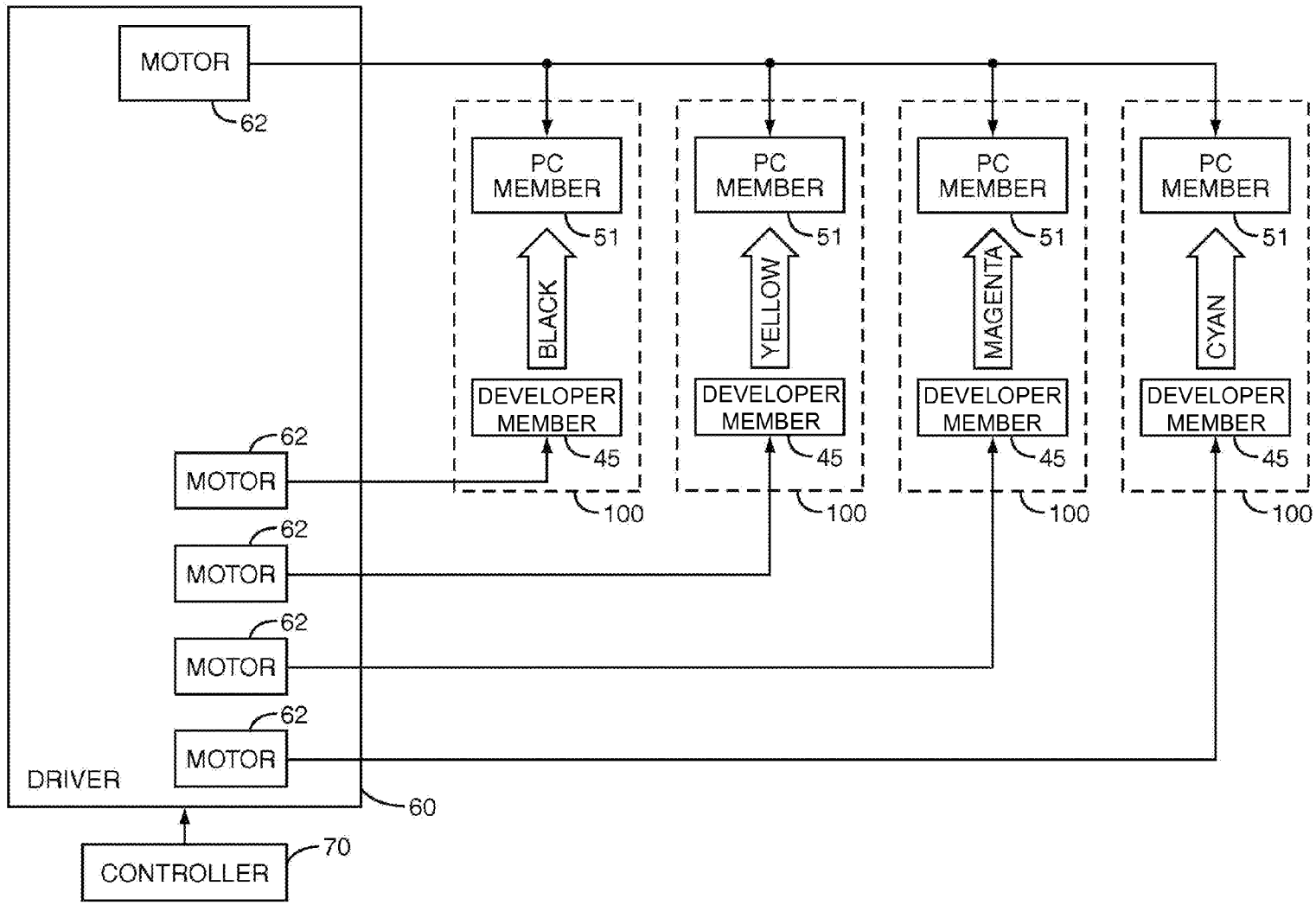
FIG. 4 shows a block diagram for one exemplary driver for FIG. 3.

FIG. 4 shows further details of one exemplary driver 60. Driver 60 includes one motor 62 for each developer member 45. This enables controller 70 to selectively and independently drive each developer member 45. In addition, driver 60 includes one or more motors 62 for the photoconductive members 51. While FIG. 4 shows a single motor 62 driving all four photoconductive members 51, it will be appreciated that driver 60 may include multiple motors for driving the photoconductive members 51. To form a toner image, the controller 70 instructs each motor 62 to continuously rotate the photoconductive members 51 and to selectively rotate one or more developer members 45 based on the color content of the image.

Controller 70 may further control a ramp up and/or ramp down process associated with each motor 62. For example, controller 70 may instruct the motor 62 associated with a particular developer member 45 to gradually accelerate up to the desired rotational speed each time the motor 62 begins rotating the developer member 45. To halt the rotation of a developer member 45, the controller 70 may instruct the motor 62 to gradually decelerate until the developer member 45 comes to a halt. To slow the rotation of a developer member 45, the controller 70 may instruct the motor 62 to gradually decelerate until the developer member 45 comes to a slower, idle rotational speed.

Figure 5:
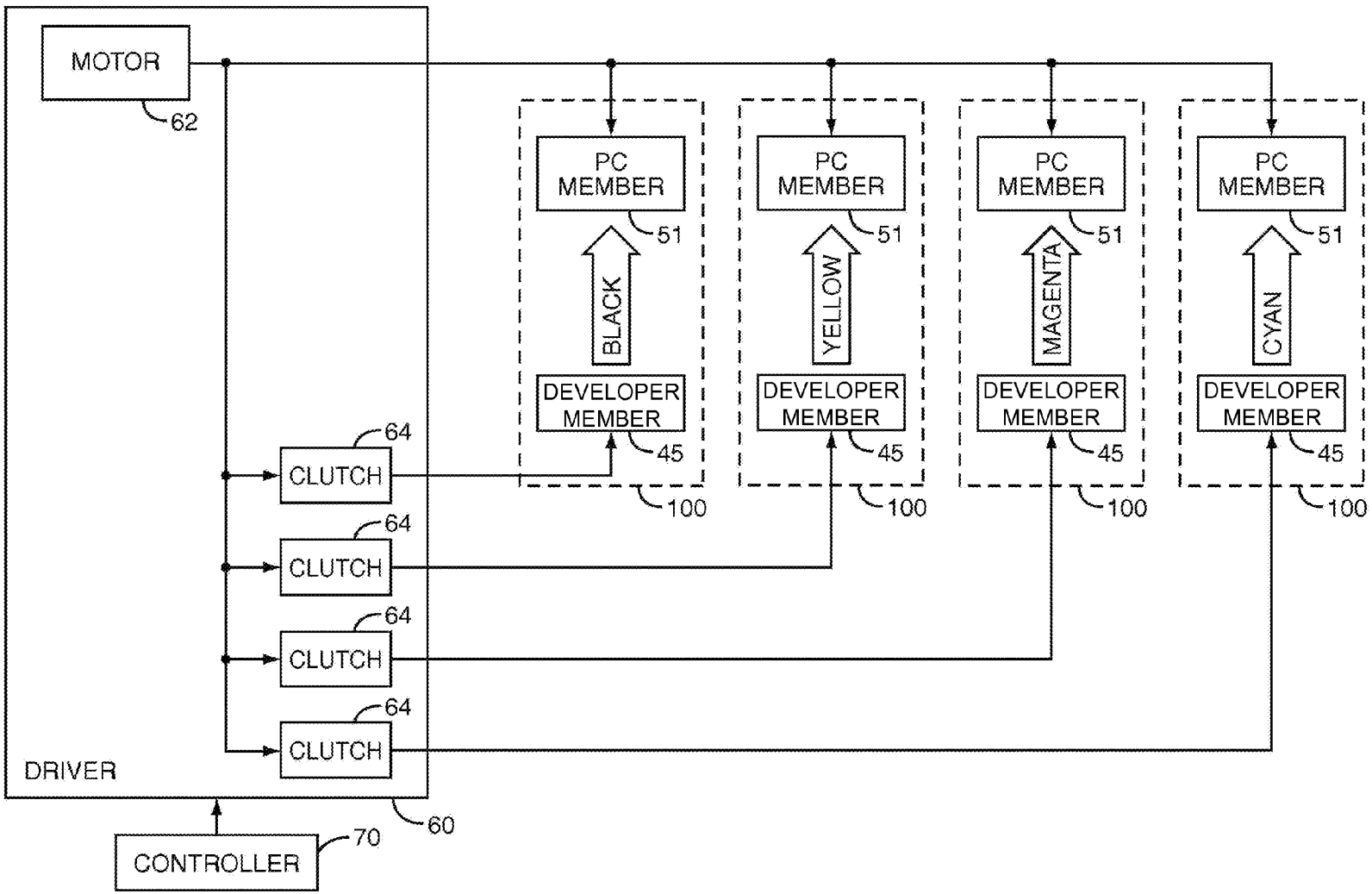
FIG. 5 shows a block diagram for another exemplary driver of FIG. 3.

While FIG. 4 shows one exemplary driver 60, it will be appreciated that the driver 60 may use other means to selectively drive the rotation of each developer member 45 independently from the photoconductive members 51. For example, driver 60 may alternatively comprise one or more motors 62 and a plurality of clutches 64, as shown in FIG. 5. In this embodiment, each developer member 45 has a corresponding clutch 64. To form a toner image, the controller 70 instructs the motor 62 to continuously rotate each photoconductive member 51. In addition, the controller 70 selectively controls each clutch 64 to selectively engage the motor 62 with one or more developer members 45 based on the color content of the image.

The independent and selective developer member control described above has several advantages. First, selectively driving a developer member 45 eliminates much of the unnecessary toner wear associated with conventional toner cartridges. This may increase the efficiency of the toner transfer process, as well as reduce toner waste, which increases the capacity of toner waste containers and reduces printing costs. Further, because slowing or stopping the developer member 45 results in fewer developer member rotations on average, heat caused by friction will be less on average, which may help reduce the overall operating temperature of the image forming device 10.

The above-described selective developer member control may also be used to perform periodic device maintenance. For example, the controller 70 may periodically instruct driver 60 to rotate one or more developer members 45 at a maintenance rotational speed to help lubricate and/or clean the interface between the developer member 45 and the doctor blade 46. In addition, such periodical rotations of the developer members 45 may help prevent the creation of flat spots on the developer member 45 caused by the doctor blade 46 and/or the rotating photoconductive member 51. It will be appreciated that the maintenance speed may be any desired rotational speed. In one embodiment, the maintenance speed is generally equivalent to the normal operational speed of the developer member 45.

The selective control of the developer member 45 may also be used to implement additional device features. For example, when the developer and photoconductive members 45, 51 abut, mechanical "scrubbing" forces work concurrently with the electrical charge on the photoconductive member 51 to transfer the toner from the developer member 45 to the photoconductive member 51. The ratio of the rotational speed of the photoconductive member 51 to the rotational speed of the developer member 45 defines a scrub rate. The scrub rate is directly related to the amount of toner transferred. For example, lower scrub rates correspond to less toner transfer. Because conventional systems simultaneously drive the developer member 45 and the photoconductive member 51, conventional systems typically have a fixed scrub rate. However, because the methods and devices of the present application independently drive each developer member 45, the controller 70 may vary the scrub rate by, for example, varying the speed of the motor 62 driving the developer member 45. Thus, the methods and devices of the present application may selectively control the amount of toner used to form a toner image by controlling the scrub rate. This feature may be used to implement a toner-saver mode, for example.

The embodiment disclosed in FIG. 1 is a direct-transfer system where the toner image is directly transferred from the photoconductive member 51 to a media sheet that moves along the media transport belt 20. The present application may also be used in a secondary-transfer system where the toner image is transferred from the photoconductive member 51 to an intermediate member. The toner image moves with the intermediate member to a secondary transfer area where it is then transferred to the media sheet. Further, the image forming device 10 illustrated in FIG. 1 includes four separate cartridges 100. In other embodiments, the device 10 may include two or more cartridges 100.

One embodiment of a cartridge 100 is illustrated in FIG. 2 and generally includes a developer unit 40 and a photoconductor unit 50. In one embodiment, these units 40, 50 may be separate and placed within the image forming device 10 such that the photoconductive member 51 abuts against the developer member 45. In another embodiment, the units 40, 50 are constructed as a single unit. The cartridge 100 may include a variety of shapes, sizes, and orientations to deliver toner from a developer member 45 to a photoconductive member 51.

The controller 70 described above may be implemented as a single microcontroller or microprocessor that includes logic circuitry to implement the functions described above. The functions implemented by the controller may be embodied in hardware (including an application specific integrated circuit (ASIC), field programmable gate array (FPGA), and the like) and/or software (including firmware, software, micro-code, and the like). Further, it will be appreciated that the controller 70 may be a separate device as shown in FIG. 1, or it may be part of the overall device controller or processor (not shown).

The controller 70 evaluates the color content of the image to determine rotation of the developer members 45. In one embodiment described above, the controller 70 divides the image into tiles in the process direction having a predetermined size, such as ¼". Controller 70 may further divide the image into other tile sizes, such as ½", 1", and the like. In another embodiment, controller 70 determines rotation based on the entirety of a printed page. If a specific color is included at any point on the page, controller 70 will drive the corresponding developer member 45 at a desired rotational speed. In another embodiment, controller 70 determines rotation on an object basis.

As discussed above, driver 60 stops or slows the rotation of each developer member 45 associated with toner colors not present in an image. As used herein, "stopping" the rotation of a developer member 45 includes halting the movement of a rotating developer member 45, as well as not rotating or otherwise preventing the rotation of the developer member 45. In one embodiment, the driver 60 prevents the rotation of the developer member 45, even when the developer member 45 is in contact with a rotating photoconductive member 51. As used herein, "slowing" the rotation of a developer member 45 includes reducing the movement of a rotating developer member 45 to a rotational speed less than a normal operating rotational speed.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, and the like and are also not intended to be limiting. Like terms refer to like elements throughout the description.

As used herein, the terms "having", "containing", "including", "comprising" and the like are open ended terms that indicate the presence of stated elements or feature, but do not preclude additional elements or feature. The articles "a", "an" and "the" are intended to include the plural as well as the singular, unless the context clearly indicates otherwise.

The present invention may be carried out in other specific ways than those herein set forth without departing from the scope and essential characteristics of the invention. In one embodiment, the developer member 45 is spaced away from the photoconductive member 51. The present embodiments are, therefore, to be considered in all respects as illustrative and not restrictive, and all changes coming within the meaning and equivalency range of the appended claims are intended to be embraced therein.

What is claimed is:

1. A system to control toner transfer during formation of a toner image within an image forming device, the system comprising:

a toner reservoir to store toner of a first color;

a developer member adapted to receive the toner from the toner reservoir;

a photoconductive member positioned in proximity to the developer member to receive the toner from the developer member; and a driver adapted to independently rotate the developer member and the photoconductive member, the driver configured to selectively stop or slow rotation of the developer member while maintaining a desired rotational speed of the photoconductive member when a first predetermined section of the toner image being formed lacks the first color.

2. The system of claim 1 wherein the photoconductive member contacts at least a portion of the developer member.

3. The system of claim 1 wherein the driver is further configured to selectively increase a rotational speed of the developer member when a second predetermined section of the toner image being formed contains the first color.

4. The system of claim 3 wherein the driver selectively increases the rotational speed of the developer member when the second predetermined section of the toner image being formed contains the first color by:

ramping up a rotational speed of the developer member to a desired rotational speed; and rotating the developer member at the desired rotational speed while forming the second predetermined section of the toner image.

5. The system of claim 3 wherein the driver is further configured to vary a ratio of a rotational speed of the developer member and a rotational speed of the photoconductive member to vary a scrub rate associated with the image forming device.

6. The system of claim 1 wherein the driver comprises:

a first motor configured to rotate the photoconductive member; and a second motor configured to selectively stop or slow rotation of the developer member when the first predetermined section of the toner image being formed lacks the first color.

7. The system of claim 1 wherein the driver comprises:

a motor configured to rotate the photoconductive member and the developer member; and a clutch configured to selectively stop rotation of the developer member while maintaining rotation of the photoconductive member when at least the first predetermined section of the toner image being formed lacks the first color.

8. The system of claim 1 wherein the driver is further configured to selectively rotate the developer member at a desired maintenance speed while rotating the photoconductive member to perform one or more maintenance operations associated with the photoconductive member and the developer member.

9. A method of controlling toner transfer during formation of a toner image within an image forming device, the method comprising:

rotating one or more photoconductive members when forming the toner image; and selectively stopping or slowing rotation of a developer member contacting at least a portion of one rotating photoconductive member based on a color content of the toner image.

10. The method of claim 9 wherein selectively stopping or slowing rotation of the developer member further comprises ramping down a rotational speed of the developer member until the developer member stops rotating or reaches a desired idle rotational speed when the toner image being formed lacks a toner color associated with the developer member.

11. The method of claim 9 wherein a first photoconductive member and a first developer member are associated with a toner having a first color and a second photoconductive member and a second developer member are associated with a toner having a second color, wherein selectively stopping or slowing rotation of the developer member based on the color content of the toner image comprises:

rotating the first developer member while stopping or slowing rotation of the second developer member when forming a first portion of the toner image containing the first color but lacking the second color; and rotating the second developer member while stopping or slowing rotation of the first developer member when forming a second portion of the toner image containing the second color but lacking the first color.

12. The method of claim 9 wherein a first photoconductive member and a first developer member are associated with a toner having a first color, and wherein selectively stopping or slowing rotation of the developer member based on the color content of the toner image comprises:

selectively rotating the first developer member at a first rotational speed when forming a first portion of the toner image containing the first color; and stopping rotation of the first developer member or slowing rotation of the first developer member to a second rotational speed less than the first rotational speed when forming a second portion of the toner image lacking the first color.

13. The method of claim 12 wherein selectively rotating the first developer member comprises:

ramping up a rotational speed of the first developer member to the first rotational speed; and rotating the first developer member at the first rotational speed when forming the first portion of the toner image.

14. The method of claim 12 further comprising varying a ratio of a rotational speed of the first developer member and a rotational speed of the first photoconductive member to vary a scrub rate associated with the image forming device.

15. The method of claim 9 further comprising selectively rotating the developer member at a maintenance rotational speed to periodically perform one or more maintenance operations associated with at least one of the photoconductive members and the developer member.

16. A method of controlling toner transfer during formation of a toner image within an image forming device, the method comprising:

rotating a developer member associated with a toner having a first color at a first rotational speed while rotating a photoconductive member at a second rotational speed when forming a first portion of the toner image containing the first color; and rotating the photoconductive member at the second rotational speed and stopping or slowing rotation of the developer member when forming a second portion of the toner image lacking the first color.

17. The method of claim 16 wherein the developer member contacts at least a portion of the photoconductive member.

18. The method of claim 16 further comprising evaluating a color content of an image to determine which portions of the toner image lack the first color.

19. The method of claim 16 further comprising varying a ratio of a rotational speed of the developer member and a rotational speed of the photoconductive member to vary a scrub rate associated with the image forming device.

20. The method of claim 16 further comprising selectively rotating the developer member at a maintenance rotational speed while rotating the photoconductive member to perform one or more maintenance operations associated with the photoconductive member and the developer member.

* * * * *